US005084149A

United States Patent [19]

Kaczur et al.

[11] Patent Number: 5,084,149

[45] Date of Patent: * Jan. 28, 1992

[54] ELECTROLYTIC PROCESS FOR PRODUCING CHLORINE DIOXIDE

[75] Inventors: Jerry J. Kaczur; David W. Cawlfield, both of Cleveland, Tenn.

[73] Assignee: Olin Corporation, Cheshire, Conn.

[ * ] Notice: The portion of the term of this patent subsequent to Aug. 20, 2008 has been disclaimed.

[21] Appl. No.: 680,478

[22] Filed: Apr. 4, 1991

Related U.S. Application Data

[63] Continuation-in-part of Ser. No. 456,437, Dec. 26, 1989, Pat. No. 5,041,196.

[51] Int. Cl.[5] ..... C25B 1/26

[52] U.S. Cl. ..... 204/101; 204/95; 204/98; 204/129; 423/477

[58] Field of Search ..... 204/95, 98, 101, 129; 423/477

[56] References Cited

U.S. PATENT DOCUMENTS

| | | | |
|---|---|---|---|
| 2,163,793 | 6/1939 | Logan | 204/9 |
| 2,717,237 | 9/1955 | Rempel | 204/101 |
| 4,456,510 | 6/1984 | Murakami et al. | 204/101 |
| 4,542,008 | 9/1985 | Capuano et al. | 423/477 |
| 4,683,039 | 7/1987 | Twardowski et al. | 204/95 |
| 4,806,215 | 2/1989 | Twardowski | 204/98 |
| 4,853,096 | 8/1989 | Lipsztajn et al. | 204/101 |

FOREIGN PATENT DOCUMENTS

| | | |
|---|---|---|
| 1956153 | 3/1956 | Japan . |
| 1158883 | 12/1981 | Japan . |

OTHER PUBLICATIONS

"Chlorine Dioxide Chemistry and Environmental Impact of Oxychlorine Compounds", published 1979 by Ann Arbor Science Publisher's Inc., p. 130.

*Primary Examiner*—T. Tung
*Assistant Examiner*—David G. Ryser
*Attorney, Agent, or Firm*—Ralph D'Alessandro

[57] ABSTRACT

An electrochemical process and electrolytic cell for manufacturing chlorine-free chlorine dioxide from a dilute alkali metal chlorite solution in a single step is disclosed. The electrolytic cell uses a porous flow-through anode and a cathode separated by a suitable separator. The alkali metal chlorite solution has a conductive salt additive.

26 Claims, 6 Drawing Sheets

ELECTROLYTIC PROCESS FOR PRODUCING CHLORINE DIOXIDE

This application is a continuation-in-part of U.S. Ser. No. 07/456,437 filed Dec. 26, 1989, now U.S. Pat. No. 5,041,196.

BACKGROUND OF THE INVENTION

This invention relates generally to the production of chlorine dioxide. More particularly the present invention relates to the electrochemical process and the electrolytic cell structure used to manufacture chlorine-free chlorine dioxide from dilute alkali metal chlorite solutions. A conductive salt is added to the aqueous chlorite feed solution that is used in the cell to produce the product chlorine-free chlorine dioxide solution. Chlorine dioxide is commercially employed as a bleaching, fumigating, sanitizing or sterilizing agent.

The chlorine dioxide can be used to replace chlorine and hypochlorite products more traditionally used in bleaching, sanitizing or sterilizing applications with resultant benefits. Chlorine dioxide is a more powerful sterilizing agent and requires lower dose levels than chlorine, at both low and at high pH levels, although it is not particularly stable at high pH levels. Chlorine dioxide produces lower levels of chlorinated organic compounds than chlorine when sterilizing raw water. Additionally, chlorine dioxide is less corrosive to metals and many polymers than chlorine.

The electrochemical production of chlorine dioxide is old and well known. U.S. Pat. No. 2,163,793 to J. O. Logan, issued June 27, 1939, discloses a process which electrolyzes solutions of an alkali metal chlorite containing an alkali metal chloride as an additional electrolyte for improving the conductivity of the solution. The process preferably electrolyzes concentrated chlorite solutions to produce gaseous chlorine dioxide in the anode compartment of an electrolytic cell having a porous diaphragm between the anode and the cathode compartments.

A process for electrolyzing an aqueous solution containing a chlorite and a water soluble salt of an inorganic oxy-acid other than sulfuric acid is disclosed in British Patent No. 714,828, published Sept. 1, 1954, by Farbenfabriken Bayer. Suitable soluble salts include sodium nitrate, sodium nitrite, sodium phosphate, sodium chlorate, sodium perchlorate, sodium carbonate and sodium acetate.

A process for producing chlorine dioxide by the electrolysis of a chlorite in the presence of a water soluble metal sulfate is taught by Rempel in U.S. Pat. No. 2,717,237, issued Sept. 6, 1955.

Japanese Patent No. 1866, published Mar. 16, 1966, by S. Saito et al teaches the use of a cylindrical electrolytic cell for chlorite solutions having a porcelain separator between the anode and the cathode. Air is used to strip the chlorine dioxide from the anolyte solution.

Japanese Patent Publication No. 81-158883, published Dec. 7, 1981, by M. Murakami et al describes an electrolytic process for producing chlorine dioxide by admixing a chlorite solution with a catholyte solution for a diaphragm or membrane cell to maintain the pH within the range of from about 4 to about 7 and electrolyzing the mixture in the anode compartment. The electrolyzed solution, at a pH of 2 or less, is then fed to a stripping tank where air is introduced to recover the chloride dioxide.

U.S. Pat. No. 4,542,008 to Capuano et al, issued Sept. 17, 1985, teaches a process for electrolyzing aqueous chlorite solutions where the sodium chlorite concentration in the anolyte is controlled by means of a photometric cell to maintain a concentration of about 0.8 to about 5% by weight. Capuano et al further teaches the use of carbon, graphite or titanium or tantalum anodes, the latter two having an electrochemically active coating. The cell is divided by a permselective cation exchange membrane.

A disadvantage of all of the above electrolytic processes is the production of chlorine dioxide in the anode compartment of the cell so that the chlorine dioxide must be recovered from the anolyte by stripping with air or some other appropriate means. If this stripping step is not accomplished, the conversion of chlorite to chlorine dioxide in the electrolyte is typically less than 20% and the direct use of the anolyte would be economically infeasible. Operation of these electrolytic processes under conditions where higher conversion rates are attempted by applying more current and lower electrolyte feed rates results in the formation of chlorate and/or free chlorine. Since chlorine is an undesirable contaminant and since the formation of chlorate is irreversible, there is a need to develop a process by which chlorite can be converted to chlorine dioxide efficiently without a separation step.

The use of chlorine dioxide solutions poses a significant problem because the generation of chlorine-free chlorine dioxide is complex and requires a number of purification steps. These steps may include the aforementioned stripping and the reabsorbing of chlorine dioxide from a generating solution to a receiving solution. A stream of air is frequently used for this purpose. However, operation of such a process is hazardous if the chlorine dioxide concentrations in the air become high enough to initiate spontaneous decomposition.

U.S. Pat. No. 4,683,039 to Twardowski et al describes another method of accomplishing this purification step by use of a gas-permeable hydrophobic membrane. This method reduces the risk of chlorine dioxide decomposition that requires additional costly equipment.

An additional problem encountered in the prior chlorine dioxide production methods, especially using dilute sodium chlorite solutions, is the less than fully effective use of the electrode surface during the electrolytic production of the product chlorine-free chlorine dioxide. This is especially aggravated where high surface area electrodes are employed because of the expectation of high conversion performance of the chlorite to chlorine dioxide. In electrolytic cells using high surface area anodes, the highest electrolyte conductivity occurs near the bottom of the electrode structure and that conductivity decreases with height traveling up the structure towards the top of the electrode in the direction of upward flow of the electrolyte solution. This occurs because the conductive chlorite ion is oxidized to non-ionized chlorine dioxide and the solution is transported through the separator towards the cathode. This phenomenon results in less efficient oxidation of the chlorite ions because of reduced charge transfer near the top of the high surface area electrode structure with a concurrent decrease in current density in this area. This, in turn, decreases the product yield obtained from the cell.

These and other problems are solved in the present invention by employing a conductive salt additive in the dilute alkali metal chlorite feed solution to an electrolytic cell in a continuous electrochemical process in the production of chlorine-free chlorine dioxide. The product chlorine-free chlorine dioxide is produced in concentrations of at least about 2 to about 10 grams per liter (gpL) and as much as about 14 gpL from dilute alkali metal chlorite solutions in a single step by use of a porous flow-through anode.

SUMMARY OF THE INVENTION

It is an object of the present invention to provide an improved electrolytic process for use in an electrolytic cell that produces a chlorine dioxide solution from aqueous chlorite directly without the need for further recovery steps of the chlorine dioxide.

It is another object of the present invention to obtain more effective utilization of the full surface area of the high surface area electrode in a process in an electrolytic cell to produce a desired concentration and quantity of chlorine dioxide in a solution.

It is another object of the present invention to provide a process and apparatus for electrolytically producing chlorine dioxide solutions that are substantially free of chlorine and which contain minimal amounts of chlorite and chlorate salts.

It is a feature of the present invention that a porous, high surface area, flow-through anode is employed in conjunction with a cation-permeable membrane to electrolyze a chlorite feed solution that has a conductive salt therein along the full length and depth of the anode.

It is another feature of the present invention that suitable conductive salts that can be added to the chlorite feed solution in the process of the present invention include those selected from the group of alkali metals consisting of acetates, benzoates, borates, bromides, carbonates, citrates, chlorides, formates, gluconates, lactates, nitrates, oxalates, phthalates, phosphates, salicylates, sulfates and tartrates.

It is another feature of the present invention that buffering salts may be added to the chlorite feed solution to moderate the pH of the chlorine dioxide solution produced from the electrolytic process and adjust the pH of the chlorite feed solution.

It is an advantage of the process of the present invention that the addition of the conductive salt to the chlorite feed solution increases the conductivity of the solution and avoids the loss of current efficiency near the top of the high surface area anode in the electrolytic cell during electrolysis.

It is another advantage of the process of the present invention that there is an increase in the percentage of the surface area utilized in the high surface area anode.

It is still another advantage of the process of the present invention that unwanted side reactions that form chlorates are avoided.

It is yet another advantage of the present invention that the electrochemical process of the present invention can efficiently convert chlorite to chlorine dioxide over a broad pH range of about 2.0 to about 10.0.

It is still another advantage of the present invention that the chlorine dioxide is produced in solution form, rather than in gaseous form, and is usable directly without further processing.

These and other objects, features and advantages of the present invention are provided in a continuous single step electrochemical process for the manufacture of chlorine-free chlorine dioxide by the addition of a conductive salt to the dilute alkali metal chlorite feed solution to thereby increase the feed solution's electrical conductivity and obtain a greater percentage utilization of the surface area of the high surface anode employed in the electrolytic cell. The instant process does not require further purification steps.

BRIEF DESCRIPTION OF THE DRAWINGS

These and other objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
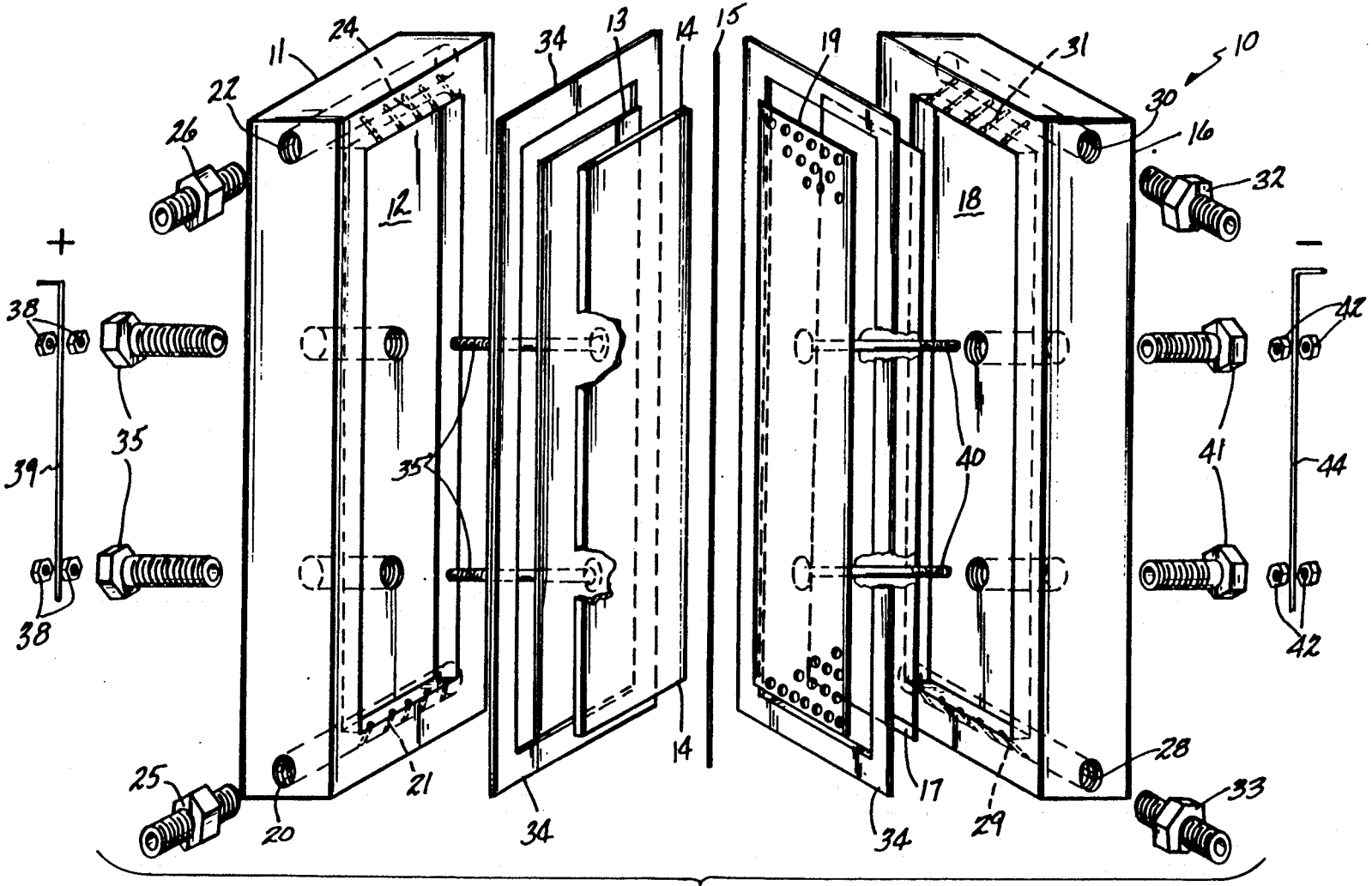
FIG. 1 is an exploded side elevational view of the electrolytic cell.
Figure 2:
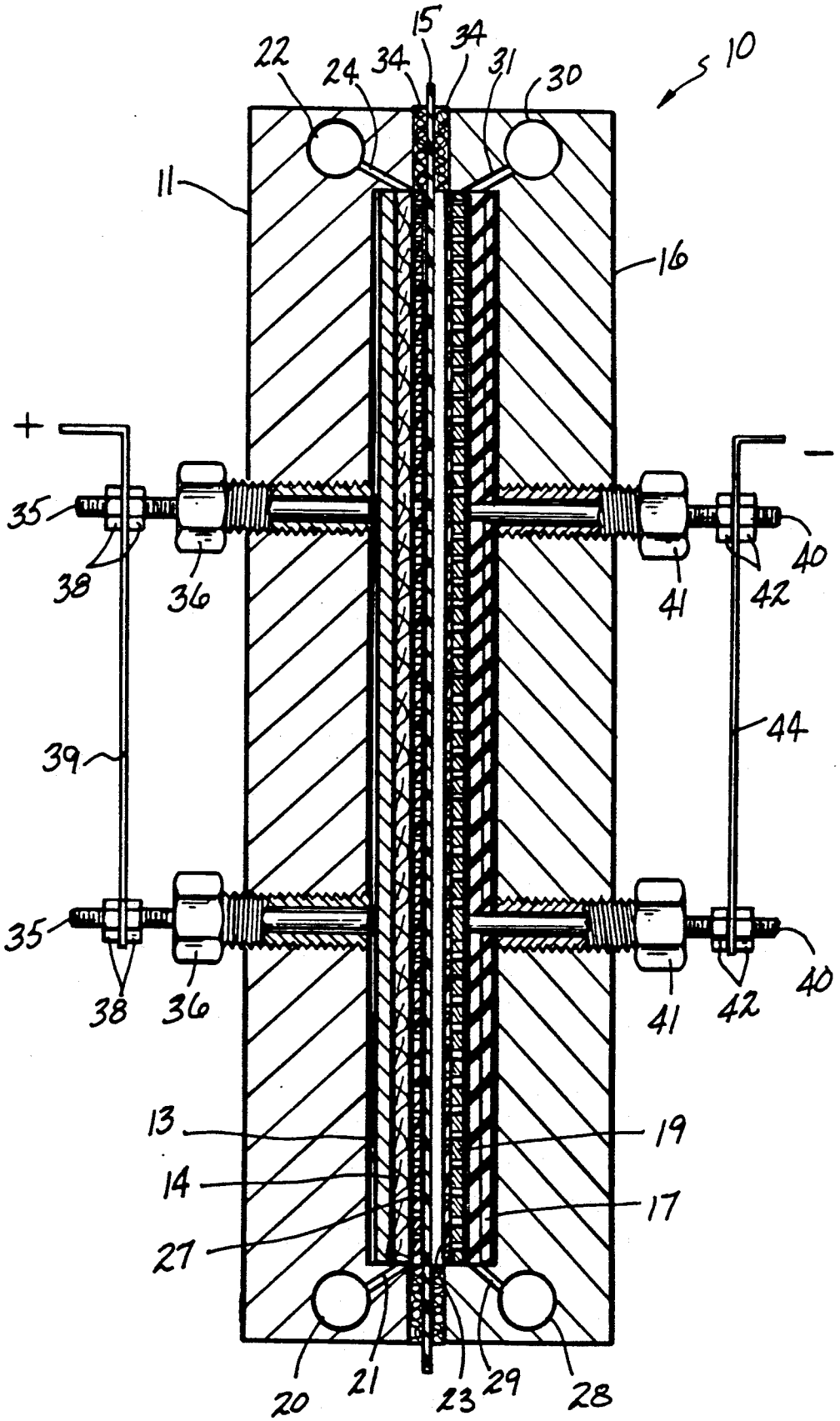
FIG. 2 is a sectional side elevational view of the electrolytic cell, but with the structure not in its fully compressed and assembled position.

The electrochemical cell indicated generally by the numeral 10, is shown in FIG. 1 in exploded view and in FIG. 2 an assembled view.

The electrochemical cell 10 is divided into an anolyte compartment 12 and catholyte compartment 18 by an oxidation resistant cation permeable ion exchange membrane 15. Appropriate sealing means, such as gaskets 34 or an O-ring, are used to create a liquid-tight seal between the membrane 15 and the anode frame 11 and the cathode frame 16.

The cathode side of the cell 10, in addition to the frame 16 and the compartment 18, includes a cathode 19 and a hydrogen gas disengaging material 17 fitted within the compartment 18. The cathode 19 is an electrode made of suitable material, such as smooth, perforated stainless steel. The cathode 19 is positioned flush with the edge of the cathode frame 16 by the use of the disengaging material 17, which is porous and physically fills the space between the inside portion of the frame 16 and the cathode 19.

Cathode conductor posts 40 transmit electrical current from a power supply (not shown) through current splitter wire 44 and cathode conductor post nuts 42 to the cathode 19. Cathode conductor post fittings 41 extend into the cathode frame 16 about posts 40 to seal against posts 40 and prevent the leakage of catholyte from the cell 10.

The preferred structure of the cathode 19 is a smooth, perforated stainless steel of the grade such as 304, 316, 310, etc.. The perforations should be suitable to permit hydrogen bubble release from between the membrane 15 and the cathode 19. Other suitable cathode materials include nickel or nickel-chrome based alloys. Titanium or other valve metal cathode structures can also be used. A corrosion resistant alloy is preferred to reduce formation of some localized iron corrosion by-products on the surface of the cathode 19 due to potential chlorine dioxide diffusion through the membrane 15 by surface contact with the cathode 19. Other suitable materials of construction for the cathode 19 include fine woven wire structures on an open type metal substrate, which can help to reduce the cell voltage by promoting hydrogen gas bubble disengagement from the surface of the cathode 19.

The anode side of the cell 10, in addition to the frame 11 and the compartment 12 of FIG. 1, includes a porous, high surface area anode 14 and an anode backplate or current distributor 13 fitted within the compartment 12. The anode 14 is an electrode made of a suitable porous and high surface area material, which increases the rate of mass transport into and away from the anode electrode surface. The high surface area anode 14 distributes the current so that the rate of charge transfer from the electrode to the anolyte solution is much lower than the rate of charge transfer through the membrane and the bulk electrolyte. Materials with a surface area to volume ratio of about 50 $cm^2/cm^3$ or higher are suitable to achieve a high percentage chlorite to chlorine dioxide conversion, with higher surface area to volume ratios being more desirable up to the point where pressure drop becomes critical. The anode must be sufficiently porous to permit anolyte to pass through it during operation. The porosity must also be sufficient so that the effective ionic conductivity of the solution inside the electrode is not substantially reduced. Anodes with a void fraction of greater than about 40% are desirable to accomplish this. The void fraction is defined as the percentage of total electrode volume that is not occupied by electrode material.

The anode 14 is positioned flush with the edge of the anode frame 11 by the use of the high oxygen overvoltage anode current distributor 13, which physically fills the space between the inside portion of the frame 11 and the anode 14. The nature of the compressible, high overvoltage, porous and high surface area anode 14 also helps to fill the space within the anolyte compartment 12 and obtain alignment with the edges of the anode frame 11.

Anode conductor posts 35 transmit electrical current from a power supply (not shown) through current splitter wire 39 and anode conductor post nuts 38 to the anode 14. Anode conductor post fittings 36 extend into the anode frame 11 about posts 35 to seal against posts 35 and prevent the leakage of anolyte from the cell 10.

The anode current distributor or backplate 13 distributes the current evenly to the flexible and compressible porous, high surface area anode 14 which does most of the high efficiency electrochemical conversion of the chlorite solution to chlorine dioxide. High oxygen overvoltage anode materials and coatings are preferably used to increase current efficiency by decreasing the amount of current lost during the electrolysis of water to oxygen and hydrogen ions on the anode surface.

Suitable high oxygen overvoltage anode materials are graphite, graphite felt, a multiple layered graphite cloth, a graphite cloth weave, carbon, and metals or metal surfaces consisting of platinum, gold, palladium, or mixtures or alloys thereof, or thin coatings of such materials on various substrates. Precious metals such as iridium, rhodium or ruthenium, alloyed with platinum group metals could also be acceptable. For example, platinum electroplated on titanium or a platinum clad material could also be utilized for the anode 14 in conjunction with a gold, platinum or oxide coated titanium current distributor 13. A thin deposited platinum conductive coating or layer on a corrosion resistant high surface area ceramic, or high surface area titanium fiber structure, or plastic fiber substrate could also be used. Conductive stable ceramic electrodes, such as the material sold by Ebonex Technologies Inc. under the trade name Ebonex(®) can also be used.

A preferred structure of the anode 14 is a porous high surface area material of a compressible graphite felt or cloth construction. The graphite surfaces can be impregnated with metallic films or oxides to increase the life of the graphite. The most preferred structure is a high surface area titanium fiber plated with platinum. Other alternatives are fluoride surface treated graphite structures to improve the anode useful life by preventing degradation by the generation of small amounts of by-product oxygen on the surface of the graphite. Since such graphite structures are relatively inexpensive, they can be used as disposable anodes that can be easily replaced after a finite period of operation.

The anode backplate or current distributor 13 can be similarly made of a graphite material which can be surface treated with agents such as those used on the porous, high surface area anode material. Other alternative materials suitable for use in the current distributor include metallic films or oxides on stable, oxidation chemical resistant valve metal structures such as titanium, tantalum, niobium, or zirconium. The coating types are metallic platinum, gold, or palladium or other precious metal or oxide type coatings. There are other oxides such as ferrite based and magnesium or manganese based oxides which may be suitable.

A suitably diluted alkali metal chlorite feed solution, preferrably sodium or potassium, is fed into anolyte compartment 12 through anode solution entry port 20 and anolyte solution distributor channels 12 at a suitable flowrate to allow for the electrochemical conversion of the chlorite ion to chlorine dioxide by the flexible and compressible porous, high oxygen overvoltage, high surface area anode 14. The electrical current is conducted to anode 14 by the high oxygen overvoltage anode backplate or current distributor 13 which has one or more metallic anode conductor posts 35 to conduct the DC electrical power from a DC power supply (not shown) Fittings 36 are used to seal against conductor posts 35 to prevent solution leakage from the cell 10. Current splitter wire 39 and anode conductor post nuts 38 are used to distribute the electrical current to the anode distributor 13. The chlorine dioxide solution product exits through anode product distributor channels 24 and anode exit ports 22.

Softened or deionized water or other suitable aqueous solution flows through cathode solution entry port 28 and catholyte distributor channels 29 (only one of which is shown in FIG. 1) into the catholyte compartment 18 at an appropriate flowrate to maintain a suitable operating concentration of alkali metal hydroxide. The alkali metal hydroxide is formed by alkali ions (not shown) passing from the anolyte compartment 12 through the cation permeable ion exchange membrane 15 into catholyte compartment 18 and by the electrical current applied at the cathode 19 to form the hydroxyl ions ($OH^-$) at the cathode surface. The cathodic reaction produces hydrogen gas, as well as the hydroxyl ions, from the electrolysis of water. The catholyte alkali metal hydroxide solution by-product and hydrogen gas (not shown) pass through cathode product distributor channels 31 into cathode exit ports 30 for removal from the cell 10 for further processing.

Electrolysis occurs in the cell 10 as the chlorite solution passes parallel to the membrane 15 through the anolyte compartment, causing the chlorine dioxide concentration to increase in the anolyte compartment 12 as the chlorite ion concentration decreases according to the following anodic reaction:

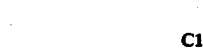

$$ClO_2 \rightarrow e^- + ClO_2.$$

Alkali metal ions, for example, sodium, from the anolyte pass through the membrane 15. As the chlorite ion content of the anolyte decreases and the chlorine dioxide content increases, a portion of the chlorine dioxide can be oxidized, depending upon the pH, to chlorate at the anode according to the following undesirable reaction:

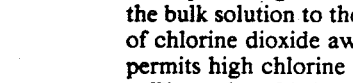

$$ClO_2 + H_2O \rightarrow HClO_3 + H^+ + e^-.$$

This undesirable reaction can be avoided by maintaining a suitably acidic anolyte and, especially at higher pH's, by controlling the potential at the anode surface while providing mass transport of the chlorite ions from the bulk solution to the anode surface and the transport of chlorine dioxide away from the anode surface. This permits high chlorine dioxide yields to be obtained.

The gaskets 34 are preferably made of oxidation resistant rubber or plastic elastomer material. Suitable types of gaskets are those made from rubber type materials such as EPDM or that sold under the trade name Viton(®), etc.. Other suitable types of gasket materials include flexible closed foam types made from polyethylene or polypropylene which can be easily compressed to a thin layer to minimize distances between the membrane 15 and the anode 13 and cathode 19 structures.

Oxidation and high temperature resistant membranes 15 are preferred. Among these are the perfluorinated sulfonic acid type membranes such as DuPont NAFION® types 117, 417, 423, etc., membranes from the assignee of U.S. Pat. No. 4,470,888, and other polytetrafluorethylene based membranes with sulfonic acid groupings such as those sold under the RAIPORE tradename by RAI Research Corporation. Other suitable types of membranes that are combinations of sulfonic acid/carboxylic acid moieties include those sold under the ACIPLEX tradename by the Asahi Chemical Company and those sold by the Asahi Glass Company under the FLEMION® tradename.

Optionally a thin protective non-conductive spacer material 27 shown in FIG. 2, such as a chemically resistant non-conductive plastic mesh or a conductive material like graphite felt, can be put between the membrane 15 and the surface of the anode 14 to permit the use of expanded metal anodes. A thin plastic spacer 23 can also be used between the cathode 19 and the membrane 15. This spacer 23 in the catholyte compartment 18 should also be a non-conductive plastic with large holes for ease of disengagement of the hydrogen gas from the catholyte compartment 18. It should be noted that FIG. 2 shows the cell 10 in cross-section, but before the cell 10 has been fully compressed in its assembled state. In this assembled state the space or gap shown in FIG. 2 between plastic spacer 23, spacer material 27 and the membrane 15 does not exist as the gaskets 34 are compressed down. The cell 10 preferably is operated with the membrane 15 in contact with the plastic spacer 23 and the spacer material 27 when they are employed and with the membrane 15 in contact with the cathode electrode 19 and the anode electrode 14 when they are not employed.

The preferred anolyte chlorite feed solution is sodium chlorite with a feed concentration of about 0.1 to about 30 gpL for one-pass through flow operation. Should it be desired to operate the cell 10 in a recirculation system, very strong sodium chlorite solutions can be used which will result in a low conversion rate of chlorite to chlorine dioxide per pass of anolyte through the anode 14. Additives in the form of salts can be used in the chlorite feed solution, such as alkali metal acetates, benzoates, borates, bromides, carbonates, citrates, chlorides, formates, gluconates, lactates, nitrates, oxalates, phthalates, phosphates, salicylates, sulfates, and tartrates to increase the conversion efficiency to chlorine dioxide, reduce operating voltage, provide pH buffering of the product solution, or add to the stability of the chlorine dioxide solution in storage.

Figure 3:
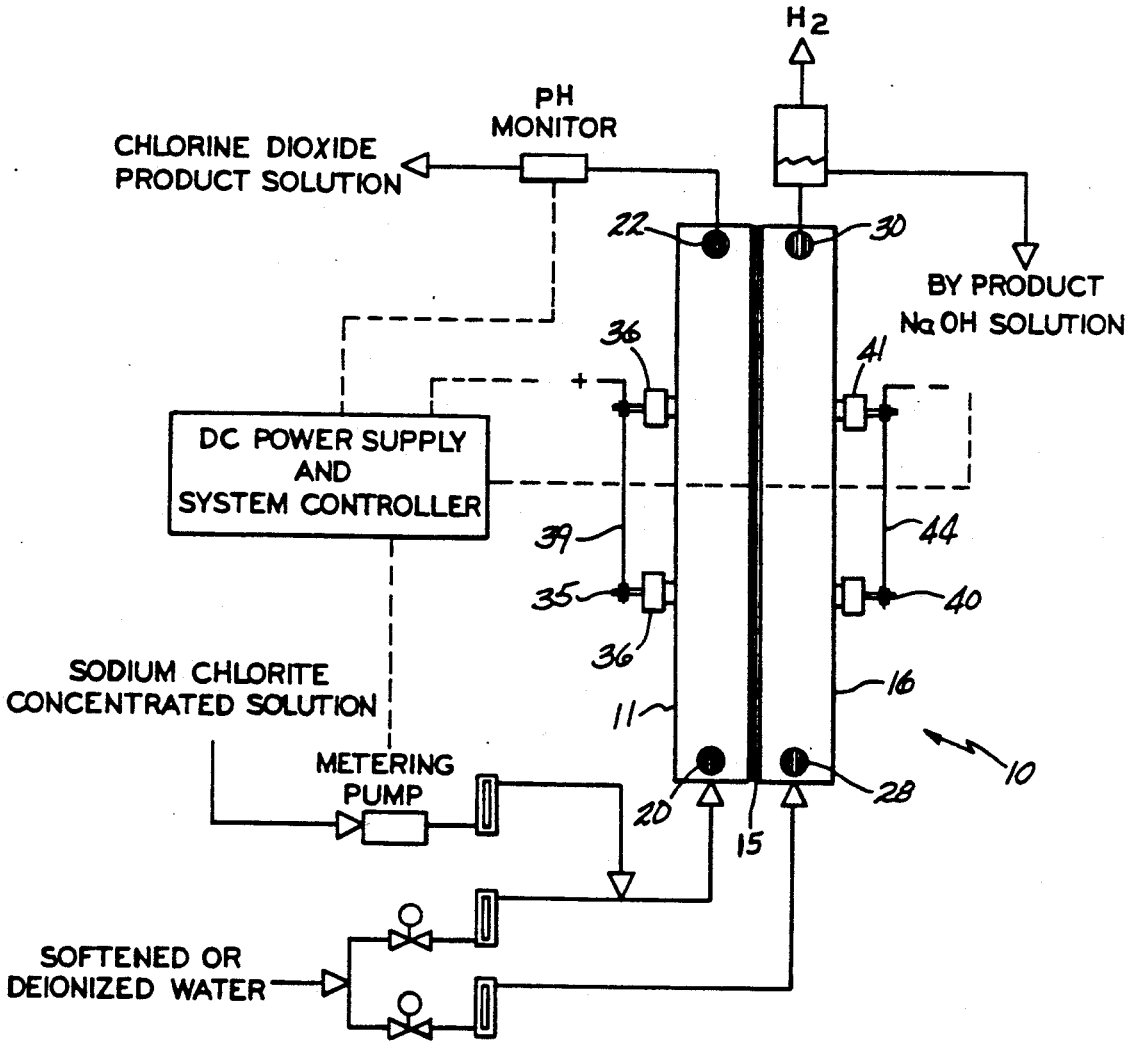
FIG. 3 is a diagrammatic illustration of a system employing the chlorine dioxide generating electrolytic cell.

In operation, the cell 10 in a system such as that shown in FIG. 3 operates with the electrolytes in a temperature range of from about 5 degrees Centigrade to about 50 degrees Centigrade, with a preferred operating temperature range of about 10 degrees Centigrade to about 30 degrees Centigrade. The anolyte feed has previously been identified as a sodium chlorite solution which is diluted by mixing with softened or deionized water to the desired concentration. The catholyte is either deionized water or softened water, depending on what is readily available and if the by-product sodium hydroxide has a potential end use for other areas of the installation, such as for pH control.

The cell 10 uses an operating current density of from about 0.01 KA/m2 to about 10 KA/m2, with a more preferred range of about 0.05 KA/m2 to about 3 KA/m2. The constant operating cell voltage and electrical resistance of the anolyte and catholyte solutions are limitations of the operating cell current density that must be traded off or balanced with current efficiency and the conversion yield of chlorite to chlorine dioxide. The cell operating voltage depends on the oxygen overvoltage of the anode materials used in the anode structures. The higher the oxygen overvoltage of the anode materials, the higher voltage at which the cell 10 can be operated and still maintain a high current efficiency and yield to chlorine dioxide. The typical operating voltage range is between about 2.0 to about 5.0 volts, with a preferred range of about 2.5 to about 4.0 volts.

Additionally the ratio of the total surface area of the anode to the superficial surface or projected area of the membrane impacts the current density at which the cell 10 can be operated and the total cell voltage. The higher that this particular ratio is, the greater is the maximum current density and the lower is the total cell voltage at which the cell can be operated.

The anolyte flow rate through the cell 10 and the residence time of the anolyte in the cell 10 are factors that affect the efficiency of the conversion of the chlorite to chlorine dioxide. There are optimum flow rates to achieve high efficiency conversion of chlorite to chlorine dioxide and to obtain a specific pH final product solution needed for the commercial applications for a single pass flow through system. The typical residence times for the single pass flow through system in the cell 10 are between about 0.1 to about 10 minutes, with a more preferred range of about 0.5 to about 4 minutes to achieve high conversion of chlorite to chlorine dioxide with high current efficiency. Very long residence times can increase chlorate formation as well as reduce the pH of the product solution to very low values (pH 2 or below) which may be detrimental to the anode structures.

The catholyte and by-product sodium hydroxide concentration should be about 0.1 to about 30 weight percent, with a preferred range of about 1 to about 10 weight percent. The optimum hydroxide concentration will depend on the membrane performance characteristics. The higher the caustic or sodium hydroxide concentration, the lower the calcium concentration or water hardness needed for long life operation of the membrane.

The addition of conductive salts to the chlorite feed solution increases the effective use of the anode surface during electrolysis by ensuring higher charge transfer occurs near the top of the electrode structure. The addition of chlorides, such as sodium chloride, and sulfates, such as sodium sulfate have been especially effective to increase charge transfer across the entire surface of the anode, especially when the ratio of the conductive salt additive to the sodium chlorite in the chlorite feed solution is from about 0.1 to about 100 to 1, preferably from about 0.2 to about 20 to 1, and more preferably from about 0.5 to about 10 to 1.

In order to exemplify the results achieved, the following examples are provided without intent to limit the scope of the instant invention to the discussion therein.

EXAMPLE 1

An electrochemical cell was constructed similar to that of FIG. 1 consisting of two compartments machined from about 1.0 inch (2.54 cm) thick acrylic plastic. The outside dimensions of both the anolyte and the catholyte compartments were about 8 inches (20.32 cm) by about 26 inches (66.04 cm) with machined internal chamber dimensions of about 6 inches (15.24 cm) by about 24 inches (60.96 cm) by about ⅛ (0.3175 cm) deep. The anolyte compartment was fitted with about a 6 inch (15.24 cm) by about 24 inch (60.96 cm) by about 1/16 inch (0.159 cm) thick titanium anode backplate with one side having an electroplated 100 microinch (2.54 micron) thick coating composed of 24 karat gold and the other side with two welded about 0.25 inch (0.635 cm) diameter by about 3 inch (7.62 cm) long titanium conductor posts. The conductor posts were fitted through holes to the outside of the anolyte compartment. The gold plated titanium plate was glued or sealed to the inside of the compartment with a silicone adhesive to prevent any fluid flow behind the anode backplate. The silicone adhesive takes up a thickness of about 0.0175 inches (0.0445 cm), leaving a recess thickness of about 0.045 inches (0.1143 cm) in the compartment. Then about a ⅛ inch (0.3175 cm) thick high surface area graphite felt (Grade WDF) anode, available from the National Electric Carbon Corporation of Cleveland, Ohio was mounted against the gold plated titanium anode conductor backplate into the recess area. The anodic surface area to volume ratio for the high surface area graphite felt anode was about 300 $cm^2/cm^3$.

The cathode compartment was fitted with a perforated 304 type stainless steel plate of the same dimensions as the anode backplate but with a thickness of about 1/32 inch (0.0794 cm) and with two welded about ¼ inch (0.635 cm) by about 3 inch (7.62 cm) long 316 type stainless steel conductor posts. The cathode was mounted flush with the surface of the acrylic compartment with 2 pieces of about 0.045 inch (0.1143 cm) thickness polypropylene mesh spacer/support material behind the perforated cathode plate to allow for hydrogen gas disengagement. The polypropylene spacer material had about 3/16 inch (0.476 cm) square hole open areas.

The electrochemical cell assembly was completed using about 1/32 inch (0.0794 cm) EPDM peroxide cured rubber gaskets (Type 6962 EPDM compound), available from the Prince Rubber & Plastics, Co. of Buffalo, N.Y., glued to each cell compartment Surface. A perfluorosufonic acid type cation permeable membrane with a 985 equivalent weight, obtained from the assignee of U.S. Pat. No. 4,470,888, was mounted between the anode and cathode compartments. The ratio of the total surface area of the anode to the superficial surface or projected area of the membrane was about 50.0. The cell was compressed and sealed together between two steel endplates with nuts and bolts and connected to a variable voltage control laboratory DC power supply with a maximum capacity of up to about 35 amperes.

The anolyte feed solution was composed of a softened water stream with about a 25 weight percent sodium chlorite solution metered into the flow stream to produce a diluted sodium chlorite feed solution to the anolyte with a concentration that could be varied between about 10 to about 20 gpL as sodium chlorite. A separate softened water stream was metered into the catholyte compartment at a flowrate of about 90 mL/min.

A corrosion resistant pH probe was mounted on the output of the anolyte stream to monitor the pH of the final product chlorine dioxide solution.

The chlorite feed solution flowrate to the cell was varied as well as product solution pH during a test run which extended over a period of more than 400 hours of operation. Operating at constant voltage between about 3.0 to about 3.2 volts with current varying between about 31 to about 34 amperes and producing a chlorine dioxide product solution with a pH of between about 6.5 to about 7.5, the cell produced a product solution containing an average of about 6 to about 8 gpL chlorine dioxide with about 2 to about 3 gpL unreacted sodium chlorite, for a chlorite conversion rate of between about 62 to about 75% and current efficiency between about 70% to about 85% in a single flow through pass operation. The by-product sodium chlorate concentration in the product solution ranged between about 1.4 to about 2.2 gpL at the various daily operating conditions. The chlorine dioxide production rate was between about 3.4 to about 4.2 lb/day.

CELL DESCRIPTION

An electrochemical cell was constructed similar to that of FIG. 1 for use in Examples 2–4, which will described hereafter. The cell consists of two compartments that were machined from about 1 inch thick PVC (polyvinyl chloride). The outside dimensions of both the anolyte and catholyte compartments were about 5 inches (12.7 cm) by about 14 inches (35.56 cm) with machined internal dimensions of about 3 inches (7.62 cm) by about 12 inches (30.48 cm) by about ⅛ inch (0.3175 cm) deep.

The anolyte compartment was fitted with about a 1/16 inch (0.1588 cm) thick by about 3 inch (7.62 cm) by about 12 inch (30.48 cm) titanium plate having about a 0.25 inch (0.635 cm) diameter titanium conductor post on the back side and about a 100 microinch (2.54 micron) platinum electroplated surface on the front side. The titanium anode plate was glued or sealed into the inside anode recess with a silicone based adhesive to prevent any solution flow behind the anode.

A platinum plated high surface area metallic felt was then placed into the about 1/16 inch (0.1588 cm) recess above the mounted anode plate. The metallic felt was prepared from about 8 grams of about a 12 micron (0.00047 inch) diameter multifilament titanium tow fiber obtained from Bekaert Corporation which had been hand pulled and laid to form a metallic felt with long fibers ranging in length from about 0.5 to about 6 inches or about 1.27 to about 15.24 cm. This was in a physical form similar to glass wool. The metallic fibers in the prepared felt were acid etched with hot concentrated HCl to remove the surface titanium oxide film and then plated with a thin platinum film by a solution electroless process using chloroplatinic acid and hydrazine hydrochloride as the reducing agent. The thickness of the platinum film coating deposited on the fibers was estimated to be about 0.16 microns using about 1.5 gm of platinum metal equivalent in the plating process. The final felt structure had a specific surface area of about 160 $cm^2/cm^3$ with a fill density of about 4.8% in the recessed area.

The catholyte compartment was fitted with about a 1/16 inch (0.1588 cm) thick by about 3 inch (7.62 cm) by about 12 inch (30.48 cm) type 316L stainless steel perforated plate having about a 0.25 inch (0.635 cm) diameter 316L stainless conductor post on the back side. The cathode plate was mounted into the inside anode recess with about a 1/16 inch (0.1588 cm) thick expanded polytetrafluorethylene mesh behind the cathode plate into order to have the cathode surface flush with the inside surface of the anolyte compartment.

The electrochemical cell assembly was completed using about a 0.020 inch (0.0508 cm) thickness polytetrafluorethylene compressible gasket tape, sold under the tradename GORE-TEX by W. L. Gore & Associates on the sealing surfaces of the cell frames. A DuPont NAFION 117 nonreinforced perfluorinated sulfonic acid cation permeable type membrane was then mounted between the anolyte and catholyte compartments.

The following example test runs were conducted with this electrochemical cell unit.

EXAMPLE 2

The cell described above was employed with a 25 percent by weight sodium chlorite concentrated feed which contained about 4 percent by weight NaCl with a NaCl:NaC102 weight ratio of 0.16:1. This feed solution was diluted in deionized water to obtain about a 9.90 gpl concentration of sodium chlorite containing about 1.6 gpl NaCl. The base diluted feed was used as is, or with the indicated addition of NaCl or Na2SO4 to the feed to demonstrate the enhanced chlorite to chlorine dioxide conversion performance of the electrochemical cell with the addition of the conductive salt to the feed solution. The combined total conductive salts to NaClO2 weight ratios in these tests were equal to about 0.57:1 for the both the NaCl and Na2SO4 feed addition runs.

The various chlorite feeds were metered into the anolyte compartment of the cell at a mass feed rate of about 21 gm/min. A softened water flow of about 10 ml/min was metered into the catholyte compartment to produce dilute by-product NaOH. The applied cell amperage was varied and the cell voltage, output pH, and chlorine dioxide concentration were monitored. Readings were taken after about 5 minutes had passed between different settings to enable the pH to stabilize and the chlorine dioxide monitor readings to become steady. The chlorine dioxide solution was monitored with a specially designed spectrophotometer utilizing a 460 nm wavelength that was calibrated for use in this high chlorine dioxide solution concentration range. The chlorine dioxide concentrations were also periodically checked by iodiometric titration. Several of the product solution samples were analyzed for chlorite and chlorate ion residuals after the chlorine dioxide was air sparged from the solution product. Where no data entries are given, no tests were performed for the residuals.

Figure 4:
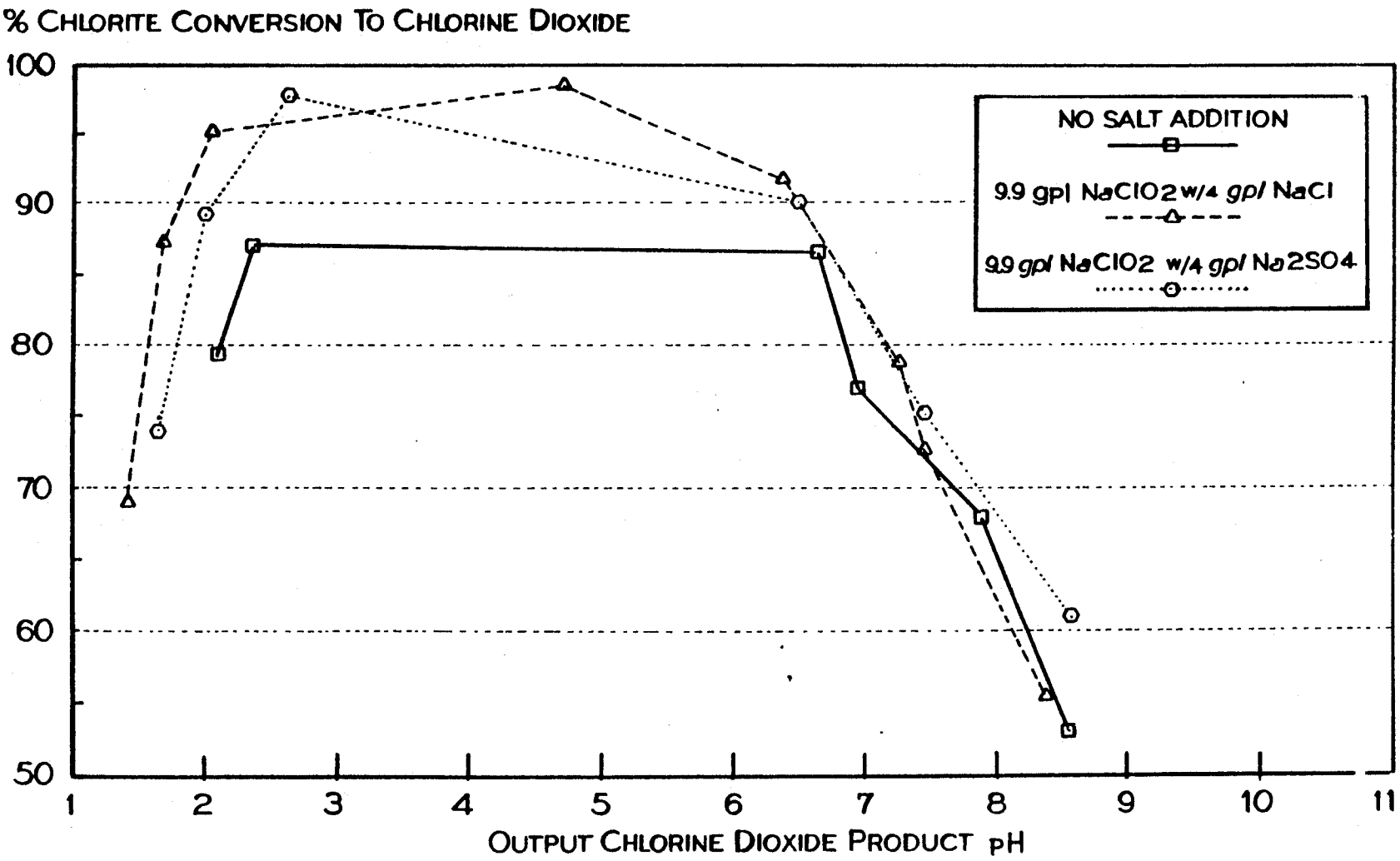
FIG. 4 is a graphical plotting of the data presented in Example 2.

The results are listed in Table I below and shown graphically in FIG. 4. Generally, the addition of NaCl to the chlorite feed at the same feed solution composition and feed rate and approximately the same cell voltage resulted in a significantly higher chlorite to chlorine dioxide conversion percentage, ranging from a high of about 14.76% to a low of about 2.43%. On apparently anomalous data point occurred where the conversion rate at 3.10 cell volts was higher than the conversion rate with the NaCl additive at about 3.08 volts. The results were similar when $Na_2SO_4$ was added to the chlorite feed, with the last data point at 3.04 cell volts being lower for the feed solution containing the additive than that without any conductive salt additive at 3.10 cell volts. However, this is misleading since the controlling factor is the pH of the output chlorine dioxide solution. This is clearly shown in FIG. 4 and by comparing data points at, for example, pH's of 2.08 without salt addition (% conversion 79.50), of 2.04 with NaCl (% conversion 95.08) and of 1.99 with $Na_2SO_4$ (% conversion 89.25). Generally the cell voltage is lower at the same operating current (cell amperage) for chlorite feed solutions containing the conductive salt additive than for chlorite feed solutions without the conductive salt additive.

TABLE I

DIRECT ELECTROCHEMICAL CHLORINE DIOXIDE GENERATOR
EXPERIMENTAL TEST RUNS
Test Cell: 12 Micron Pt Plated Titanium Felt Anode
Effect Of Added Salts To Chlorite Feed Solution On Cell Performance

| FEED gpl | FLOWRATE gm/min | CELL VOLTS | CELL AMPS | pH | ClO2 gpl | CONVERSION % | RESIDUALS IN CONC. PRODUCT SOLUTION ClO2- gpl | ClO3- gpl |
|---|---|---|---|---|---|---|---|---|
| NO ADDITIONAL SALTS ADDED TO BASE FEED: | | | | | | | | |
| 9.90 | 21.00 | 2.25 | 1.74 | 8.55 | 3.91 | 52.96 | | |
| 9.90 | 21.00 | 2.36 | 2.27 | 7.88 | 5.01 | 67.85 | | |
| 9.90 | 21.00 | 2.44 | 2.62 | 6.94 | 5.68 | 76.93 | | |
| 9.90 | 21.00 | 2.62 | 3.18 | 6.64 | 6.39 | 86.54 | | |
| 9.90 | 21.00 | 2.97 | 3.59 | 2.35 | 6.42 | 86.95 | | |

TABLE I-continued

DIRECT ELECTROCHEMICAL CHLORINE DIOXIDE GENERATOR
EXPERIMENTAL TEST RUNS
Test Cell: 12 Micron Pt Plated Titanium Felt Anode
Effect Of Added Salts To Chlorite Feed Solution On Cell Performance

| FEED gpl | FLOWRATE gm/min | CELL VOLTS | CELL AMPS | pH | ClO2 gpl | CONVERSION % | RESIDUALS IN CONC. PRODUCT SOLUTION ClO2- gpl | ClO3- gpl |
|---|---|---|---|---|---|---|---|---|
| 9.90 | 21.00 | 3.10 | 4.24 | 2.08 | 5.87 | 79.50 | | |
| | | | 4 gpl NaCl ADDED TO BASE FEED: | | | | | |
| 9.90 | 21.00 | 2.20 | 1.74 | 8.39 | 4.09 | 55.39 | | |
| 9.90 | 21.00 | 2.28 | 2.24 | 7.45 | 5.35 | 72.46 | | |
| 9.90 | 21.00 | 2.34 | 2.57 | 7.26 | 5.81 | 78.69 | | |
| 9.90 | 21.00 | 2.44 | 3.10 | 6.37 | 6.77 | 91.69 | 0.84 | 0.65 |
| 9.90 | 21.00 | 2.51 | 3.54 | 4.72 | 7.26 | 98.33 | 0.24 | 0.83 |
| 9.90 | 21.00 | 2.83 | 4.09 | 2.04 | 7.02 | 95.08 | | |
| 9.90 | 21.00 | 2.94 | 4.58 | 1.67 | 6.44 | 87.22 | | |
| 9.90 | 21.00 | 3.08 | 5.43 | 1.41 | 5.09 | 68.94 | | |
| | | | 4 gpl Na2SO4 ADDED TO BASE FEED: | | | | | |
| 9.90 | 21.00 | 2.29 | 2.09 | 8.57 | 4.51 | 61.08 | | |
| 9.90 | 21.00 | 2.37 | 2.58 | 7.45 | 5.55 | 75.17 | | |
| 9.90 | 21.00 | 2.50 | 3.17 | 6.50 | 6.65 | 90.07 | | |
| 9.90 | 21.00 | 2.75 | 3.62 | 2.62 | 7.21 | 97.65 | 0.00 | 1.18 |
| 9.90 | 21.00 | 2.91 | 4.08 | 1.99 | 6.59 | 89.25 | | |
| 9.90 | 21.00 | 3.04 | 4.58 | 1.63 | 5.46 | 73.95 | | |

EXAMPLE 3

Figure 5:
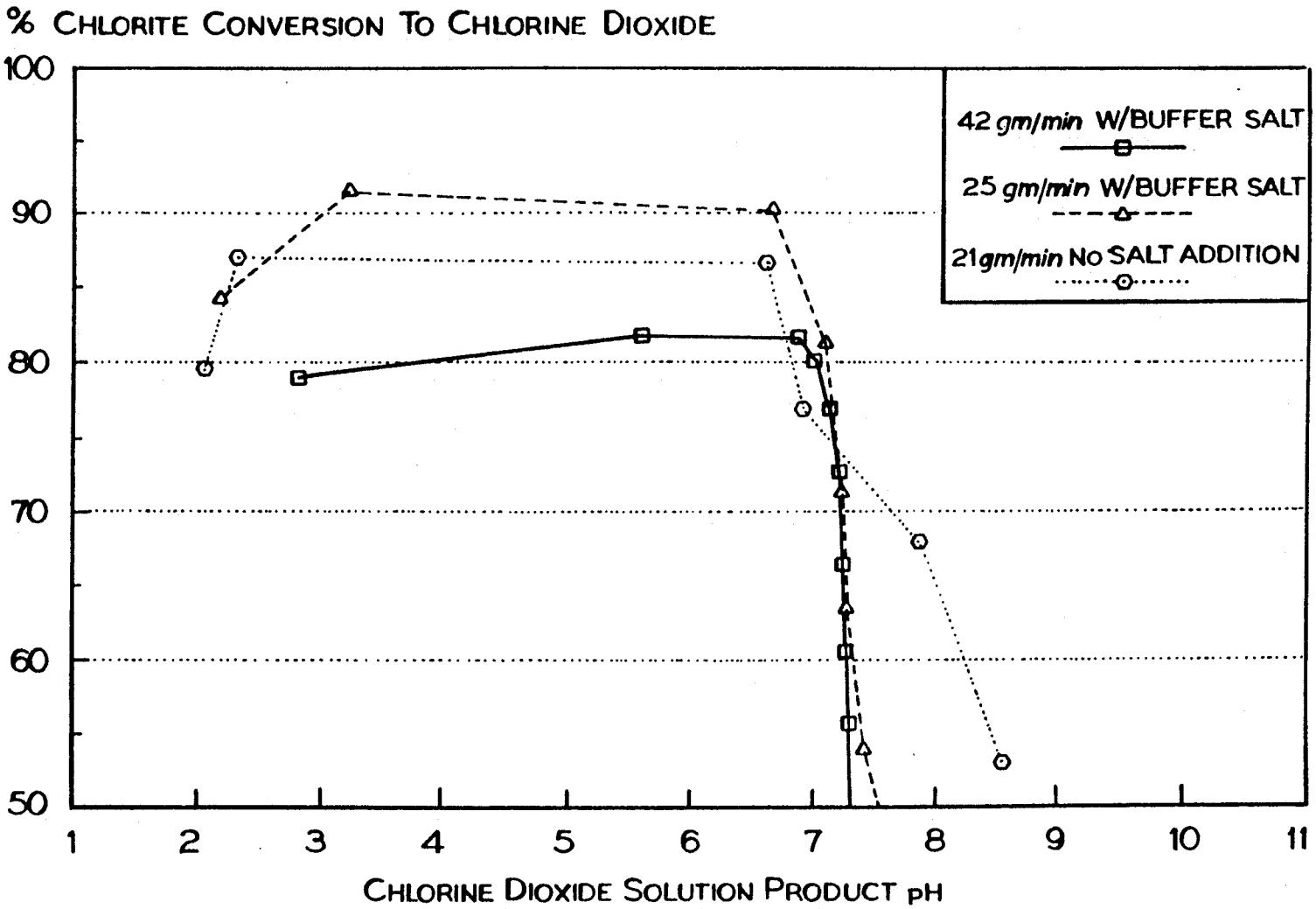
FIG. 5 is a graphical plotting of the data presented in Example 3 compared with a comparable flowrate and no conductive salt additive.

The same cell as was used in Example 2 was employed With a Ch)Orite feed solution that was buffered with sodium dihydrogen phosphate (NaH2PO4) to change the operating pH control characteristics of the chlorine dioxide generator and to show the effect of solution flowrates through the cell anode compartment. Approximately 2.72 grams of NaH2PO4 was added to about 4 liters of a dilute 10 gpl sodium chlorite feed solution to obtain a final solution mix with a pH of 6.93. The NaH2PO4 buffer salt to NaClO2 weight ratio in the mix was about 0.068:1 and the total conductive salts to NaClO2 weight ratio was 0.23:1. The results are listed in Table II below and show that although there was an increased flowrate of the feed solution with the buffered salt additive through the cell, there was a slightly lower conversion rate of the chlorite to chlorine dioxide and lower production of $ClO_2$ over the results obtained in Example 2 with or without the conductive salt additive. As a general finding, the conversion rate and production of chlorine dioxide decreased as the flowrate of the chlorite feed solution with the buffer salt additive increased. This occurs because there is less residence and contact time of the chlorite feed solution with the high surface area anode structure. However, there is still the increased efficiency at the percentage conversion of the chlorite feed solution with the conductive buffered salt additive at the same operating cell amperage over the chlorite feed solution without any conductive salt additive as shown in FIG. 5. The particular percentage conversion efficiency of the chlorite to chlorine dioxide versus pH operating curve will vary for each particular conductive buffer salt employed because of the different pH buffering characteristics of each conductive buffer salt.

TABLE II

DIRECT ELECTROCHEMICAL CHLORINE DIOXIDE GENERATOR
EXPERIMENTAL TEST RUNS
Test Cell: 12 Micron Pt Plated Titanium Felt Anode
Tests Using Phosphate Buffered Chlorite Feed

| FEED gpl | FLOWRATE gm/min | CELL VOLTS | CELL AMPS | pH | ClO2 gpl | CONVERSION % | RESIDUALS IN CONC. PRODUCT SOLUTION ClO2- gpl | ClO3- gpl |
|---|---|---|---|---|---|---|---|---|
| 10.00 | 42.00 | 2.35 | 2.76 | 7.27 | 3.45 | 46.26 | | |
| 10.00 | 42.00 | 2.39 | 3.09 | 7.30 | 3.72 | 49.88 | | |
| 10.00 | 42.00 | 2.44 | 3.50 | 7.30 | 4.14 | 55.51 | | |
| 10.00 | 42.00 | 2.51 | 3.94 | 7.28 | 4.51 | 60.47 | | |
| 10.00 | 42.00 | 2.58 | 4.46 | 7.25 | 4.94 | 66.24 | | |
| 10.00 | 42.00 | 2.67 | 5.00 | 7.22 | 5.41 | 72.54 | | |
| 10.00 | 42.00 | 2.77 | 5.44 | 7.14 | 5.72 | 76.70 | | |
| 10.00 | 42.00 | 2.86 | 5.94 | 7.02 | 5.96 | 79.91 | | |
| 10.00 | 42.00 | 3.02 | 6.09 | 7.04 | 6.00 | 80.45 | | |
| 10.00 | 42.00 | 2.99 | 6.47 | 6.90 | 6.08 | 81.52 | | |
| 10.00 | 42.00 | 3.18 | 7.10 | 5.62 | 6.09 | 81.66 | | |
| 10.00 | 42.00 | 3.26 | 7.60 | 2.82 | 5.88 | 78.84 | 1.82 | 0.64 |
| | | | MASS FLOWRATE LOWERED to 25 gm/min: | | | | | |
| 10.00 | 25.00 | 2.20 | 1.58 | 7.75 | 3.14 | 42.10 | | |
| 10.00 | 25.00 | 2.28 | 2.09 | 7.42 | 4.01 | 53.77 | | |
| 10.00 | 25.00 | 2.36 | 2.60 | 7.29 | 4.73 | 63.42 | | |
| 10.00 | 25.00 | 2.43 | 2.96 | 7.24 | 5.31 | 71.20 | | |
| 10.00 | 25.00 | 2.54 | 3.47 | 7.11 | 6.05 | 81.12 | | |
| 10.00 | 25.00 | 2.77 | 4.09 | 6.69 | 6.72 | 90.10 | | |
| 10.00 | 25.00 | 3.30 | 4.25 | 3.24 | 6.82 | 91.44 | 0.74 | 0.97 |

TABLE II-continued

DIRECT ELECTROCHEMICAL CHLORINE DIOXIDE GENERATOR
EXPERIMENTAL TEST RUNS
Test Cell: 12 Micron Pt Plated Titanium Felt Anode
Tests Using Phosphate Buffered Chlorite Feed

| FEED gpl | FLOWRATE gm/min | CELL VOLTS | CELL AMPS | pH | ClO2 gpl | CONVERSION % | RESIDUALS IN CONC. PRODUCT SOLUTION ClO2- gpl | ClO3- gpl |
|---|---|---|---|---|---|---|---|---|
| 10.00 | 25.00 | 3.68 | 4.75 | 2.20 | 6.28 | 84.20 | | |

EXAMPLE 4

The same cell as was used in Example 2 was employed with about a 12.5 percent by weight NaClO2 feed solution with about 15 percent by weight NaCl. This was prepared by mixing about 25 percent by weight NaClO2 solution and about 26% high purity NaCl brine to obtain about a 1.20:1 NaCl to NaClO2 weight ratio feed mix. The feed was diluted to obtain between about 10.04 to about 10.39 gpl NaClO2 as noted. The tests were conducted to show the effect on the chlorite to chlorine dioxide conversion efficiency of flowrate through the high surface area anode as well as chlorine dioxide production rate. The faster the solution flowrate, the lower the percentage conversion of chlorite to chlorine dioxide and the higher ClO2 production rate at a specific operating pH.

Figure 6:
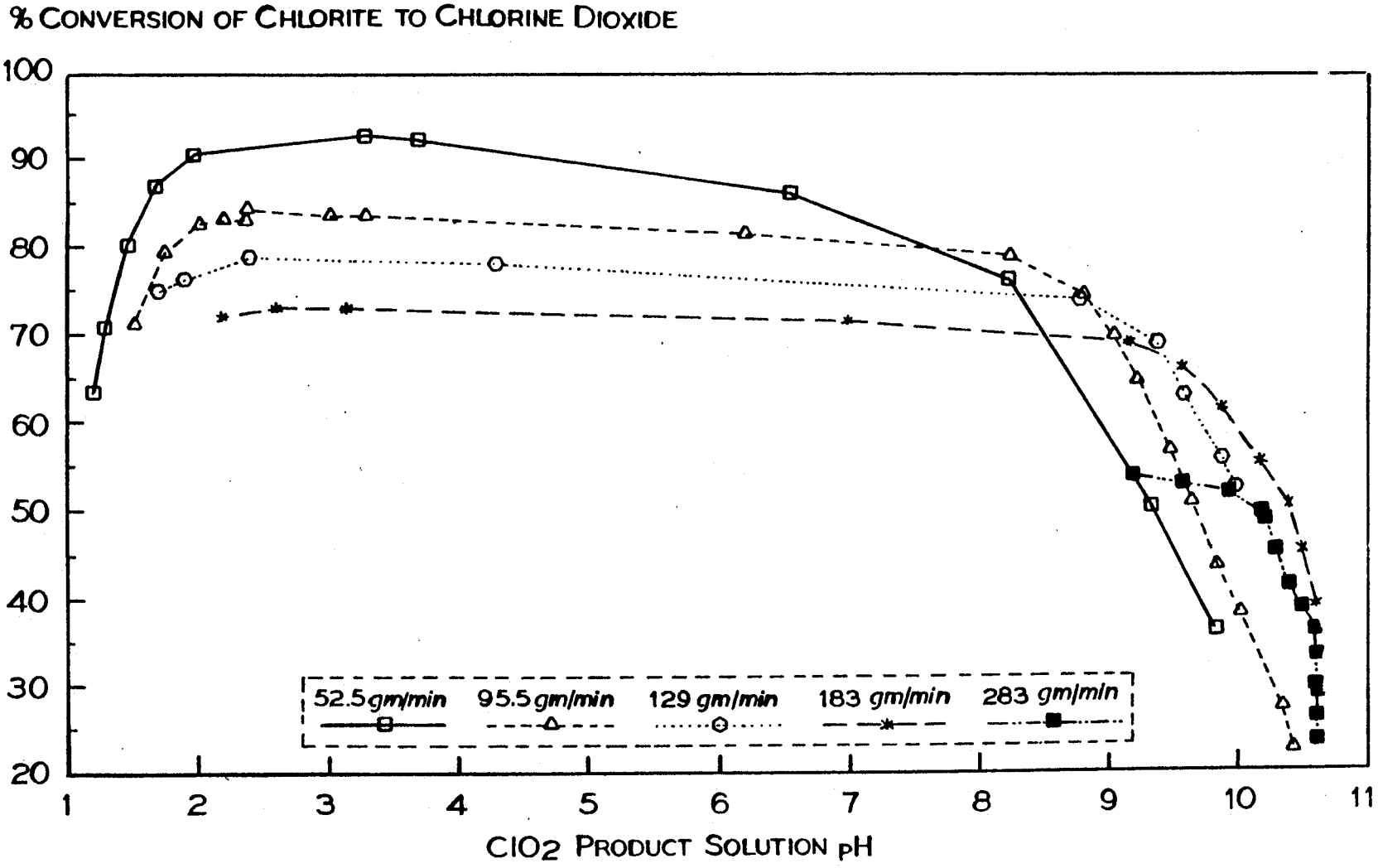
FIG. 6 is a graphical plotting of the data in Example 4.

The results are listed in Table III below and are shown in FIG. 6. These results show generally the decrease in the percentage conversion of chlorite to chlorine dioxide of increased feed solution flowrate at pH's below 8. Above a pH of about 8, and especially above a pH of 9, there is a clear drop at all of the flowrates in the percentage conversion of chlorite to chlorine dioxide, but the drop is proportionally greater for the lower flowrates. Compared with the results of Example 2, it appears that the higher concentration of conductive salt additives as in Example 2 gives a higher percentage conversion rate of chlorite to chlorine dioxide and higher production of chlorine dioxide. However, the results of this example show that the daily chlorine dioxide production rate in terms of pounds per day production of chlorine dioxide can be increased by increased chlorite solution feedrate.

TABLE III

DIRECT ELECTROCHEMICAL CHLORINE DIOXIDE GENERATOR
EXPERIMENTAL TEST RUNS
Test Cell: 12 Micron Pt Plated Titanium Felt Anode
Tests Using Chlorite/Chloride Feed at Various Flowrates

| FEED gpl | FLOWRATE gm/min | CELL VOLTS | CELL AMPS | pH | ClO2 gpl | CONVERSION % | ClO2 PRODUCTION RATE IN lb/Day |
|---|---|---|---|---|---|---|---|
| 10.39 | 52.50 | 2.37 | 3.30 | 9.84 | 2.81 | 36.26 | 0.47 |
| 10.39 | 52.50 | 2.48 | 4.70 | 9.35 | 3.91 | 50.46 | 0.65 |
| 10.39 | 52.50 | 2.81 | 7.60 | 8.25 | 5.92 | 76.40 | 0.99 |
| 10.39 | 52.50 | 2.98 | 8.90 | 6.56 | 6.69 | 86.33 | 1.12 |
| 10.39 | 52.50 | 3.15 | 9.90 | 3.68 | 7.16 | 92.40 | 1.19 |
| 10.39 | 52.50 | 3.05 | 10.00 | 3.28 | 7.19 | 92.79 | 1.20 |
| 10.39 | 52.50 | 3.25 | 10.50 | 1.97 | 7.02 | 90.59 | 1.17 |
| 10.39 | 52.50 | 3.23 | 11.20 | 1.67 | 6.73 | 86.85 | 1.12 |
| 10.39 | 52.50 | 3.32 | 12.00 | 1.46 | 6.22 | 80.27 | 1.04 |
| 10.39 | 52.50 | 3.44 | 13.20 | 1.30 | 5.49 | 70.85 | 0.92 |
| 10.39 | 52.50 | 3.52 | 14.10 | 1.21 | 4.92 | 63.49 | 0.82 |
| 10.39 | 95.50 | 2.40 | 3.40 | 10.43 | 1.75 | 22.58 | 0.53 |
| 10.39 | 95.50 | 2.44 | 4.30 | 10.34 | 2.12 | 27.36 | 0.64 |
| 10.39 | 95.50 | 2.62 | 6.30 | 10.03 | 2.97 | 38.33 | 0.90 |
| 10.39 | 95.50 | 2.71 | 7.40 | 9.85 | 3.39 | 43.75 | 1.03 |
| 10.39 | 95.50 | 2.84 | 8.80 | 9.66 | 3.95 | 50.97 | 1.20 |
| 10.39 | 95.50 | 2.93 | 10.00 | 9.50 | 4.41 | 56.91 | 1.34 |
| 10.39 | 95.50 | 3.12 | 11.80 | 9.25 | 5.04 | 65.04 | 1.53 |
| 10.39 | 95.50 | 3.34 | 12.90 | 9.07 | 5.43 | 70.07 | 1.65 |
| 10.39 | 95.50 | 3.41 | 14.00 | 8.83 | 5.79 | 74.72 | 1.76 |
| 10.39 | 95.50 | 3.46 | 15.10 | 8.26 | 6.13 | 79.11 | 1.86 |
| 10.39 | 95.50 | 3.55 | 16.00 | 6.22 | 6.33 | 81.69 | 1.92 |
| 10.39 | 95.50 | 3.63 | 17.00 | 3.28 | 6.49 | 83.75 | 1.97 |
| 10.39 | 95.50 | 3.61 | 17.00 | 3.01 | 6.48 | 83.62 | 1.96 |
| 10.39 | 95.50 | 3.71 | 18.00 | 2.39 | 6.53 | 84.27 | 1.98 |
| 10.39 | 95.50 | 3.75 | 18.00 | 2.38 | 6.44 | 83.11 | 1.95 |
| 10.39 | 95.50 | 3.80 | 18.80 | 2.20 | 6.44 | 83.11 | 1.95 |
| 10.39 | 95.50 | 3.88 | 19.50 | 2.01 | 6.40 | 82.59 | 1.94 |
| 10.39 | 95.50 | 3.97 | 21.00 | 1.75 | 6.15 | 79.37 | 1.86 |
| 10.39 | 95.50 | 4.08 | 23.40 | 1.52 | 5.52 | 71.24 | 1.67 |
| 10.27 | 129.00 | 3.11 | 12.90 | 10.00 | 4.04 | 52.75 | 1.65 |
| 10.27 | 129.00 | 3.19 | 13.90 | 9.90 | 4.28 | 55.88 | 1.75 |
| 10.27 | 129.00 | 3.34 | 16.10 | 9.60 | 4.84 | 63.19 | 1.98 |
| 10.27 | 129.00 | 3.52 | 18.10 | 9.40 | 5.30 | 69.20 | 2.17 |
| 10.27 | 129.00 | 3.62 | 20.10 | 8.80 | 5.69 | 74.29 | 2.33 |
| 10.27 | 129.00 | 3.76 | 22.00 | 4.30 | 6.00 | 78.33 | 2.46 |
| 10.27 | 129.00 | 3.90 | 24.20 | 2.40 | 6.04 | 78.86 | 2.47 |
| 10.27 | 129.00 | 4.06 | 26.30 | 1.90 | 5.85 | 76.38 | 2.40 |
| 10.27 | 129.00 | 4.16 | 28.80 | 1.70 | 5.74 | 74.94 | 2.35 |
| 10.27 | 183.00 | 3.04 | 13.00 | 10.60 | 3.00 | 39.17 | 1.74 |

TABLE III-continued

DIRECT ELECTROCHEMICAL CHLORINE DIOXIDE GENERATOR EXPERIMENTAL TEST RUNS
Test Cell: 12 Micron Pt Plated Titanium Felt Anode
Tests Using Chlorite/Chloride Feed at Various Flowrates

| FEED gpl | FLOWRATE gm/min | CELL VOLTS | CELL AMPS | pH | ClO2 gpl | CONVERSION % | ClO2 PRODUCTION RATE IN lb/Day |
|---|---|---|---|---|---|---|---|
| 10.27 | 183.00 | 3.19 | 15.80 | 10.50 | 3.50 | 45.70 | 2.03 |
| 10.27 | 183.00 | 3.36 | 17.90 | 10.40 | 3.88 | 50.66 | 2.25 |
| 10.27 | 183.00 | 3.54 | 20.30 | 10.20 | 4.26 | 55.62 | 2.47 |
| 10.27 | 183.00 | 3.66 | 23.20 | 9.90 | 4.74 | 61.88 | 2.75 |
| 10.27 | 183.00 | 3.80 | 25.50 | 9.60 | 5.08 | 66.32 | 2.95 |
| 10.27 | 183.00 | 3.92 | 27.30 | 9.18 | 5.31 | 69.33 | 3.08 |
| 10.27 | 183.00 | 3.99 | 29.20 | 7.00 | 5.50 | 71.81 | 3.20 |
| 10.27 | 183.00 | 4.16 | 31.60 | 3.14 | 5.61 | 73.24 | 3.26 |
| 10.27 | 183.00 | 4.26 | 33.20 | 2.60 | 5.61 | 73.24 | 3.26 |
| 10.27 | 183.00 | 4.38 | 35.70 | 2.19 | 5.52 | 72.07 | 3.21 |
| 10.04 | 283.00 | 2.87 | 12.10 | 10.60 | 1.77 | 23.64 | 1.59 |
| 10.04 | 283.00 | 2.94 | 13.30 | 10.60 | 1.97 | 26.31 | 1.77 |
| 10.04 | 283.00 | 3.06 | 15.10 | 10.60 | 2.19 | 29.25 | 1.97 |
| 10.04 | 283.00 | 3.11 | 16.00 | 10.60 | 2.24 | 29.91 | 2.01 |
| 10.04 | 283.00 | 3.23 | 18.20 | 10.60 | 2.50 | 33.39 | 2.25 |
| 10.04 | 283.00 | 3.32 | 20.30 | 10.60 | 2.72 | 36.33 | 2.44 |
| 10.04 | 283.00 | 3.42 | 22.00 | 10.50 | 2.91 | 38.86 | 2.61 |
| 10.04 | 283.00 | 3.55 | 23.90 | 10.40 | 3.11 | 41.53 | 2.79 |
| 10.04 | 283.00 | 4.00 | 27.10 | 10.30 | 3.42 | 45.67 | 3.07 |
| 10.04 | 283.00 | 4.19 | 30.00 | 10.22 | 3.67 | 49.01 | 3.30 |
| 10.04 | 283.00 | 4.19 | 29.50 | 10.20 | 3.72 | 49.68 | 3.34 |
| 10.04 | 283.00 | 4.34 | 32.10 | 9.95 | 3.90 | 52.08 | 3.50 |
| 10.04 | 283.00 | 4.45 | 34.00 | 9.60 | 3.98 | 53.15 | 3.58 |
| 10.04 | 283.00 | 4.60 | 35.70 | 9.21 | 4.04 | 53.95 | 3.63 |
| 10.04 | 283.00 | 4.59 | 35.70 | 9.20 | 4.05 | 54.09 | 3.64 |

While the preferred structure in which the principles of the present invention have been incorporated as shown and described above, it is to be understood that the invention is not to be limited to the particular details thus presented, but, in fact, widely different means may be employed in the practice of the broader aspects of this invention.

For example, the cell 10 can also be arranged in a bipolar cell type arrangement using a solid plate type anode/cathode conductor or backplate. The anode/-cathode combination could be a platinum clad layer on stainless steel, titanium, or niobium which is commercially available and is prepared by heat/pressure bonding. The platinum layer would be about 125 to about 250 microinches thick to reduce cost. In this design there would be separators/spacers between the membrane and cathode side to provide a hydrogen gas release zone.

The cell 10 could be operated in a system utilizing a single pass through design or in a system utilizing an anolyte recycle loop feed type operation to achieve optimum sodium chlorite conversion to chlorine dioxide in the anode compartment. Further, the product solution from the electrolytic cell 10 can be operated to produce a high concentration chlorine dioxide solution containing up to about 14 gpL. The chlorine dioxide can then be sparged from the solution with air or nitrogen to transfer the chlorine-free chlorine dioxide in the gas phase to a process using it in, for example, municipal water treatment, gas sterilization systems, and fumigant systems. The gaseous chlorine dioxide from the solution can be easily removed down to a level of about 0.5 to about 1.0 gpL, for a removal efficiency of the chlorine dioxide from the solution on the order of about 90% or better for about 10 to about 14 gpL chlorine dioxide solutions.

Also, although the material of construction for the anolyte and catholyte compartments has been described in Example 1 as acrylic plastic, other suitable corrosion resistant materials are possible. Suitable corrosion resistant metals such as titanium, tantalum, niobium, zirconium or other valve metals, as well synthetic materials such as polyethylene, polyvinyl chloride, polyester resin or fiber reinforced resins could also be employed.

It should be understood that the catholyte can be any suitable aqueous solution, including alkali metal chlorides, and any appropriate acids such as hydrochloric, sulfuric, phosphoric, nitric, acetic or others. It is also possible to operate the cell 10 and the instant process with any appropriate separator, not merely a cation exchange membrane, as long as the separator is permeable to anions and cations to obtain the required electrical conductivity therethrough. Any microporous separator is acceptable and where an aqueous acid solution is used as the catholyte, the separator can be a diaphragm of the type used in diaphragm electrolytic cells. In this case some back migration of anions from the catholyte compartment to the anolyte compartment is expected and may be permissible, depending upon the application of the final product.

Where stronger chlorine dioxide product solutions are required, it is possible to obtain the desired product by using a higher concentration alkali metal chlorite feed solution of, for example, from about 50 to about 70 gpL in conjunction with an above atmospheric pressure in the cell 10. The higher pressure, from about 1.2 to about 5 atmospheres, is necessary to prevent the potentially explosive chlorine dioxide at concentrations of above about 50 gpL from coming out of solution into the explosive vapor phase.

The scope of the appended claims is intended to encompass all obvious changes in the details, materials, and arrangements of parts, which will occur to one of skill in the art upon a reading of the disclosure.

Having thus described the invention, what is claimed is:

1. A continuous electrochemical process for producing chlorine dioxide solution from an aqueous alkali metal chlorite solution in an electrolytic cell having an aqueous catholyte solution in a catholyte compartment, an anolyte in an anolyte compartment, and a separator between the anolyte and catholyte compartments, comprising the steps of:

(a) feeding an aqueous alkali metal chlorite solution having a conductive salt additive into the anolyte compartment of the electrolytic cell to form the anolyte;

(b) feeding an aqueous solution into the catholyte compartment of the cell to form the aqueous catholyte solution;

(c) electrolyzing the anolyte by directing the anolyte in a single pass through a porous, high surface area anode to oxidize chlorite ions on the high surface area anode having a surface area to volume ratio of at least about 50 $cm^2/cm^3$ to produce a substantially chlorine-free solution of chlorine dioxide in the anolyte compartment and to cause the alkali metal ions to pass through the separator into the catholyte compartment; and (d) removing the chlorine dioxide solution from the anolyte compartment.

2. The process according to claim 1 wherein the conductive salt additive is selected from the group of alkali metal salts consisting of acetates, benzoates, borates, bromides, carbonates, citrates, chlorides, formates, gluconates, lactates, nitrates, oxalates, phthalates, phosphates, salicylates, sulfates and tartrates.

3. The process according to claim 2 wherein sodium chloride is present in the aqueous alkali metal chlorite solution.

4. The process according to claim 2 wherein the ratio of the concentration of the conductive salt additive to the chlorite in the chlorite solution is from about 0.1 to about 100 to 1.

5. The process according to claim 4 further comprising using sodium chlorite as the chlorite solution.

6. The process according to claim 2 wherein the ratio of the concentration of the conductive salt additive to the chlorite in the chlorite solution is from about 0.2 to about 20 to 1.

7. The process according to claim 2 wherein the ratio of the concentration of the conductive salt additive to the chlorite in the chlorite solution is from about 0.5 to about 10 to 1.

8. The process according to claim 1 further comprising maintaining the concentration of the aqueous alkali metal chlorite solution between about 0.1 to about 30 grams per liter.

9. The process according to claim 1 further comprising maintaining the temperature of the anolyte and the aqueous catholyte solution during cell operation between about 5 degrees centigrade to about 50 degrees centigrade.

10. The process according to claim 1 further comprising operating the cell with a current density of between about 0.1 to about 10 kiloamperes per square meter.

11. The process according to claim 1 further comprising maintaining the residence time of anolyte in the cell from between about 0.1 to about 10 minutes.

12. The process according to claim 11 further comprising using a porous high surface area anode having a void fraction of greater than about 40 percent.

13. The process according to claim 12 further comprising operating the cell with an operating voltage of between about 2.0 and about 5.0 volts.

14. The process according to claim 1 further comprising using a cation permselective ion exchange membrane as the separator.

15. The process according to claim 1 further comprising using a dilute alkali metal hydroxide solution as the aqueous catholyte solution.

16. The process according to claim 15 further comprising electrolyzing the aqueous catholyte solution to produce gaseous hydrogen and alkali metal hydroxide in the catholyte compartment.

17. The process according to claim 16 further comprising removing the gaseous hydrogen and alkali metal hydroxide from the catholyte compartment.

18. The process according to claim 17 further comprising using sodium or potassium as the alkali metal.

19. The process according to claim 1 further comprising operating the cell with an anolyte pH of between about 2.0 to about 10.0.

20. The process according to claim 1 further comprising operating the cell at a pressure of between about 1.2 and about 5 atmospheres.

21. The process according to claim 1 further comprising operating the cell with water s the aqueous solution.

22. In a continuous electrochemical process for producing a chlorine-free chlorine dioxide solution from an aqueous alkali metal chlorite anolyte solution in an electrolytic cell having an aqueous catholyte solution and a separator between anolyte and catholyte compartments, the aqueous alkali metal chlorite solution anolyte solution being electrolyzed in a single pass through a porous, high surface area anode having a surface area to volume ratio of at least about 50 $cm^2/cm^3$ to produce the chlorine-free chlorine dioxide solution that is removed from the anolyte compartment, the improvement comprising using a conductive salt additive in the aqueous alkali metal chlorite anolyte solution.

23. The process according to claim 22 further comprising operating the cell with a cation permselective membrane as the separator.

24. The process according to claim 22 wherein the conductive salt additive is selected from the group consisting of acetates, benzoates, borates, bromides, carbonates, citrates, chlorides, formates, gluconates, lactates, nitrates, oxalates, phthalates, phosphates, salicylates, sulfates and tartrates.

25. The process according to claim 22 wherein sodium chloride is present in the aqueous alkali metal chlorite solution.

26. The process according to claim 22 further comprising using sodium chlorite as the aqueous alkali metal chlorite anolyte solution.

* * * * *